US008368499B2

(12) United States Patent
Tuomisto

(10) Patent No.: US 8,368,499 B2
(45) Date of Patent: Feb. 5, 2013

(54) DISC WINDING

(75) Inventor: Timo Tuomisto, Vaasa (FI)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 12/874,471

(22) Filed: Sep. 2, 2010

(65) Prior Publication Data

US 2010/0328008 A1 Dec. 30, 2010

Related U.S. Application Data

(63) Continuation of application No. PCT/FI2009/000032, filed on Mar. 4, 2009.

(30) Foreign Application Priority Data

Mar. 4, 2008 (FI) ..... 20080181

(51) Int. Cl.
*H01F 27/28* (2006.01)
*H01F 27/30* (2006.01)

(52) U.S. Cl. ..... 336/189; 336/188; 336/199; 336/207; 336/208; 336/222

(58) Field of Classification Search ..... 336/60, 336/188, 189, 196, 199, 207, 208, 220, 222
See application file for complete search history.

(56) References Cited

U.S. PATENT DOCUMENTS 3,348,182 A * 10/1967 Baker et al. ..... 336/187
3,368,174 A * 2/1968 Fischer ..... 336/60

FOREIGN PATENT DOCUMENTS

| | | | |
|---|---|---|---|
| DE | 1097557 B | | 1/1961 |
| DE | 1266396 B | | 4/1968 |
| EP | 0370574 A1 | | 5/1990 |
| JP | 58-148414 | * | 9/1983 |
| JP | 58-148414 A | | 9/1983 |
| JP | 1-246807 A | | 10/1989 |
| WO | WO 03/067616 A1 | * | 8/2003 |

OTHER PUBLICATIONS

Finnish Search Report issued on Jul. 9, 2008, by Finnish Patent Office as the International Searching Authority for International Application No. PCT/FI2009/000032.
Written Opinion (PCT/ISA/237) issued on Jun. 17, 2009, by Finnish Patent Office as the International Searching Authority for International Application No. PCT/FI2009/000032.

* cited by examiner

*Primary Examiner* — Mohamad Musleh
*Assistant Examiner* — Mangtin Lian
(74) *Attorney, Agent, or Firm* — Buchanan Ingersoll & Rooney PC

(57) ABSTRACT

A disc winding of a power transformer or a choke is provided. The disc winding includes a plurality of parallel single strand conductors. The working time for bending the strand conductors of cross-overs is reduced by sharing the winding axially in plurality of sections, and the cross-overs within a section are identical twin cross-overs. The strand conductors are bent in two groups, and a standardized twin transposition cross-over is provided between the sections such that the strand conductors are being bent in two groups. The outermost strand conductor is in the first group, and the remaining strand conductors are in the other group.

7 Claims, 4 Drawing Sheets

DISC WINDING

RELATED APPLICATIONS

This application claims priority as a continuation application under 35 U.S.C. §120 to PCT/FI2009/000032, which was filed as an International Application on Mar. 29, 2009 designating the U.S., and which claims priority to Finnish Application 20080181 filed in Finland on Mar. 4, 2008. The entire contents of these applications are hereby incorporated by reference in their entireties.

FIELD

The present disclosure is related to a disc winding of a power transformer, a distribution transformer and/or a choke including two or more parallel single strand conductors or twin cables.

BACKGROUND INFORMATION

To make a conductor easier to bend and for reducing eddy currents, a conductor of power transformer winding can include several parallel flat copper or aluminium strand conductors instead of one big rectangular one.

Each strand conductor has an insulation layer on its surface allowing the potential difference between adjacent strand conductors and prohibiting an eddy current from one strand conductor to another.

However, the respective lengths of parallel strand conductors can become different from one another as the average distance from the transformer core is different. As a result, the induced voltage between strand conductors becomes different from each other, and due to galvanic connections of both ends, circulating currents exist, which heats up the winding. Also, the load current does not divide equally to each strand conductor, which decreases the total load capacity. Two solutions have been proposed to avoid these problems.

A known winding structure has a mirror-image type transposing cross-over between each two adjacent disc, wherein each individual strand conductor on each cross-over is bent separately. However, a significant amount of separate strand conductors must be bent manually and carefully insulated according to this technique.

In FIG. 6 of WO03/067616, a disc winding is axially shared in a plurality of sections, and each cross-over in a section is a type where all strand conductors are bent essentially parallel. A twin-type transposing cross-over between each two adjacent sections brings the current and voltage balance between the strand conductors. The winding can be shared to as many axial sections as there are parallel copper or aluminium strand conductors in a conductor to achieve a good voltage balance. Alternatively, the winding could be shared to the number of sections, which number is a multiple of the amount of parallel strand conductors.

In a case of an even number of sections, such as six or eight sections, there are an odd number of transposing cross-overs between sections, and a mirror-image transposing cross-over is located in the middle of the winding making the cross-over location optimization calculation procedure needless.

In FIG. 7 of WO03/067616, a disc winding is close to the same as it was in FIG. 6, but the complicated mirror-image transposing cross-over at the middle of the winding has been replaced by a half and half type transposing cross-over.

A pneumatic, hydraulic or electrically driven hand tool, for example, can be implemented as a parallel bending means for bending each parallel strand conductors in one stage.

The above-mentioned progressive windings are fine for full turn discs, but cannot be used for windings with half turn discs. The use of half turns increases the flexibility of designing the windings to optimize the manufacturing process.

A lot of mechanical power is needed to bend several strand conductors parallel. Semiautomatic winding machines can be equipped with two bending heads for making twin-type cross-overs. For making a parallel bending, the strand conductors are to be shared between these two bending heads to share the mechanical power needed for bending. A strict positioning of the two bunches of the strand conductors for bending heads is needed to obtain a really parallel bending and to have it in one spacer span between two adjacent spacers. The insulation paper which is used for each second strand conductor broadens the parallel bended conductor. Accordingly, there is a desire to make the windings more suitable for semiautomatic winding machines in general and especially for half turn discs.

SUMMARY

An exemplary embodiment provides a disc winding for a power transformer or a choke with cylindrical windings. The exemplary disc winding comprises a conductor including a plurality of parallel flat strand conductors, and a plurality of axial sections in which the winding is shared. Each section comprises a plurality of discs, and each disc comprises a plurality of turns of the conductor. Each cross-over within a section is a twin cross-over in which the strand conductors are bent in two groups such that at least two of the strand conductors are comprised in the first group, and the remaining strand conductors are comprised in the second group. A twin transposition cross-over is provided between each two axially adjacent sections such that an outermost strand conductor is bent to an innermost group and the remaining strand conductors are bent in another group.

BRIEF DESCRIPTION OF THE DRAWINGS

Additional refinements, advantages and features of the present disclosure are described in more detail below with reference to exemplary embodiments illustrated in the drawings, in which.

DETAILED DESCRIPTION

Exemplary embodiments of the present disclosure provide a disc winding in which a uniform cross-over type is provided within a section suitable for semi-automated winding machine with two bending heads and a standardized transposing cross-over between each adjacent section.

Figure 1:
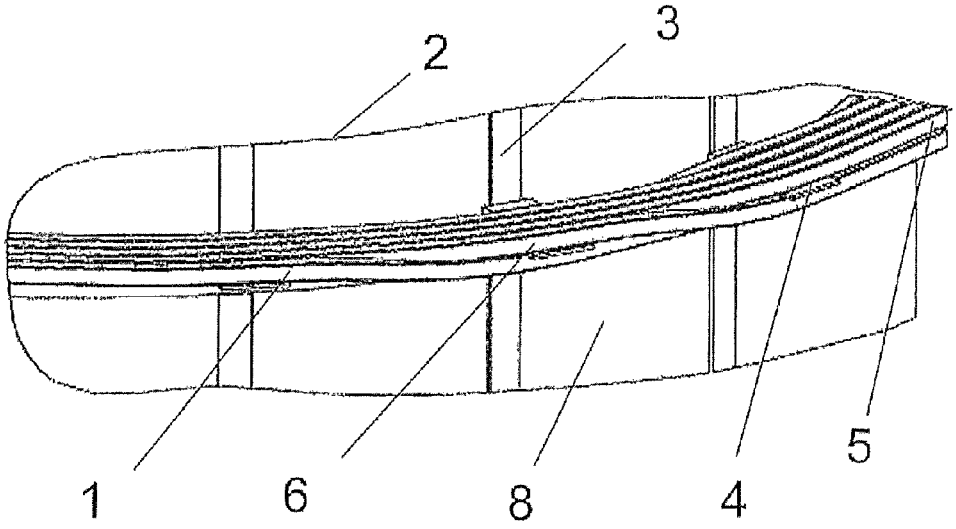
FIG. 1 is a schematic view of a winding with a twin cross-over in which the strand conductors are bent in two groups, according to an exemplary embodiment of the present disclosure.

FIG. 1 shows a partial schematic view of a disc winding of a power transformer according to an exemplary embodiment of the present disclosure. The exemplary disc winding includes a conductor 1 wound around an insulating coil cylinder 2. Sticks 3 are provided to ensure the axial flow of a coolant but are also arranged to align insulating spacers 4 of the disc winding. According to an exemplary embodiment, one disc 5 can include several radial turns of conductor 1 and is axially separated from the previous disc and the following disc by insulating spacers 4. The space between two spacers 4 is called a spacer span 8. According to an exemplary embodiment of the present disclosure, in one section, the conductor 1 is transferred from a disc to another by bending it as a twin cross-over 6.

Figure 2:
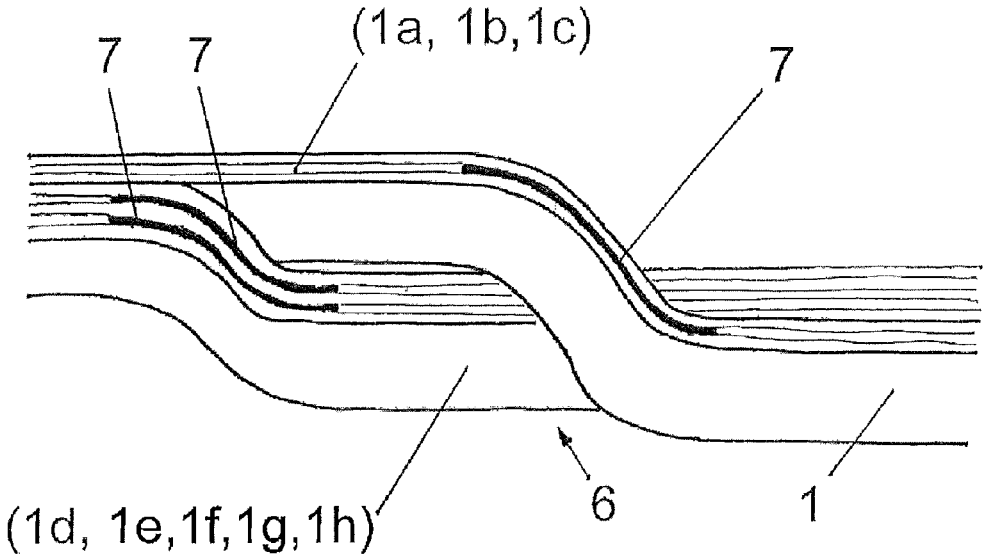
FIG. 2 shows a schematic view of the twin cross-over with additional insulation strips.

FIG. 2 shows a detailed schematic view of the twin cross-over 6 according to an exemplary embodiment of the present disclosure. In the example illustrated in FIG. 2, one conductor 1 includes eight essentially parallel strand conductors 1*a* . . . 1*h*. In a twin cross-over 6, the first group with three adjacent strand conductors 1 *a*,1*b*,1*c* are bent from one disc 5 to another in a first spacer span 8 between two adjacent spacers 4, and the second group with the remaining five strand conductors 1*d*,1*e*,1*f*,1*g*,1*h* are bent in the next spacer span 8.

To ensure a sufficient insulation level of the conductor 1, each second strand conductor can be wrapped by an additional insulation strip 7. If eight strand conductors were provided in a parallel bending, for example, four insulator strips 7 could be located parallel to expand the radial diameter of the disc 5. By comparison, a twin cross-over in this example needs only one or two parallel insulation strips 7, thus saving radial space of the winding.

Figure 3:
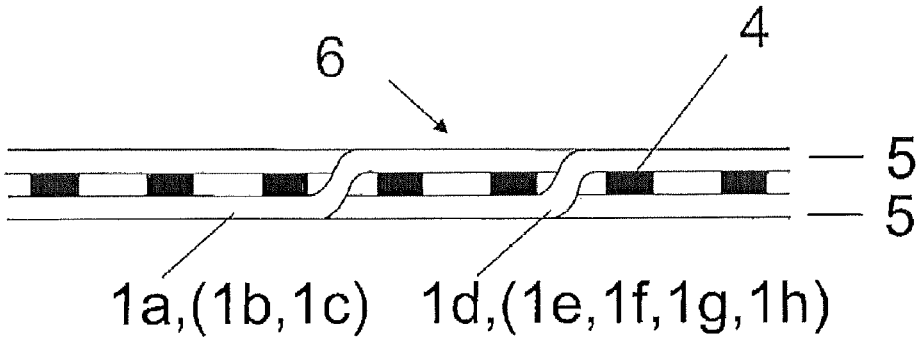
FIG. 3 shows a twin cross-over in which eight parallel strand conductors are bent in two groups, according to an exemplary embodiment of the present disclosure.

FIG. 3 shows another example of a twin cross-over 6 in which the strand conductors are bent in two groups. In the example illustrated in FIG. 3, eight strand conductors 1*a* . . . 1*h* are divided in one group of three strand conductors 1*a*,1*b*, 1*c* and into a second group of five strand conductors 1*d* . . . 1*h*.

According to the disclosure, the number of strand conductors shared among these two groups could vary depending on the total number of strand conductors. For example, in power transformer windings, there can be four to eight strand conductors, but there could be even more strand conductors in a conductor. This means that the number of strand conductors in the first group could be from two to half of the total number of strand conductors, and the second group can include the rest of the strand conductors.

For example, in case there are four strand conductors, two strand conductors could be in the first group and two strand conductors could be in the second group. In case there are five strand conductors, two strand conductors could be in the first group, and three strand conductors could be in the second group. In case there are six strand conductors, two strand conductors could be in the first group, and four strand conductors could be in the second group, or the first and second groups could each include three strand conductors. In case there are seven strand conductors, two strand conductors could be in the first group and five strand conductors could be in the second group, or three strand conductors could be in the first group and four strand conductors could be in the second group. In case there are eight strand conductors, the first and second groups could respectively include, for example, (i) two and six strand conductors, (ii) three and five strand conductors, or (iii) four and four strand conductors. According to an exemplary embodiment, the number of strand conductors are divided evenly between the first and second groups for half turn discs.

Because each cross-over within a section is equal to each other, the two bunches of strand conductors run through the two bending heads of the semi-automated winding machine. Because there is no need to remove the strand conductors from the bending head during the winding within one section, manual work is avoided and time is saved.

Figure 4:
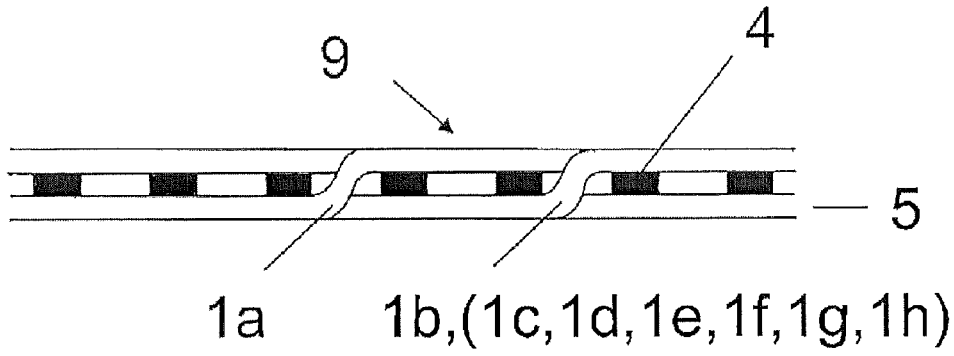
FIG. 4 shows a twin transposing cross-over in which eight parallel strand conductors are bent in two groups, according to an exemplary embodiment of the present disclosure.

FIG. 4 shows an example of a twin transposition cross-over which is used between each adjacent two sections according to an exemplary embodiment of the present disclosure. In any case, the outermost strand conductor will first be bent separately from all other strand conductors. The rest of the strand conductors keep their internal order and are to be bent in the next spacer span 8. Accordingly, there is no need for a user to read any instructions for each transposition, because they are standardized to be this one type in any case.

The number of transposing cross-overs for one winding is n−1 for an odd number of strand conductors (n), and (n/2)−1 for windings with an even number of strand conductors (n).

Figure 5:
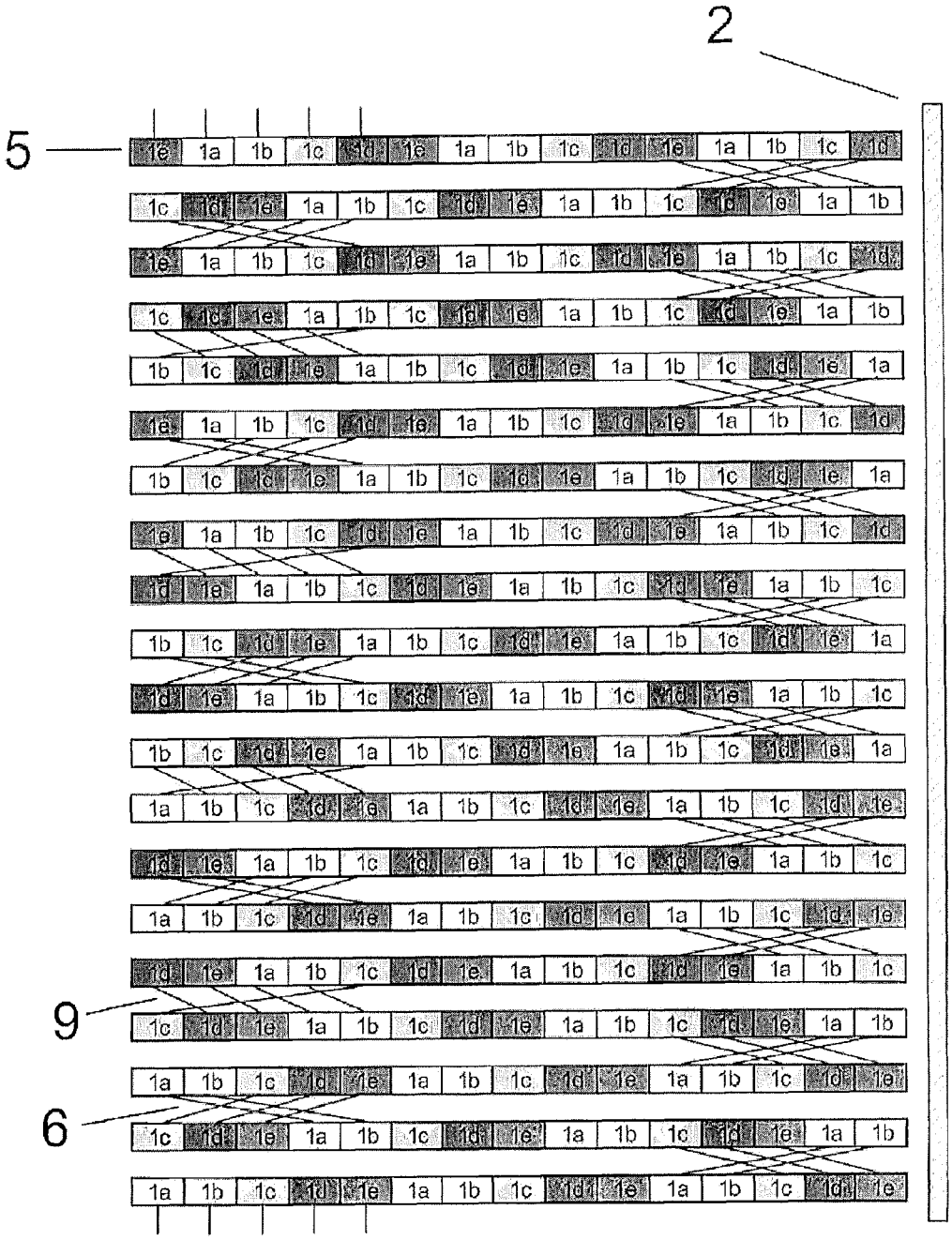
FIG. 5 shows a disc winding cross-over diagram for five parallel strand conductors for full turn discs, according to an exemplary embodiment of the present disclosure.

FIG. 5 shows an example of a disc winding cross-over diagram for five parallel strand conductors 1*a* . . . 1*e* according to an exemplary embodiment of the present disclosure. The winding includes five sections in this example, where each section includes four discs 5. The total number of discs 5 in a winding depends of the electrical requirements. For example, in a power transformer, the number of discs can be from 60 to 130. In the illustrated example of FIG. 5, the first disc of the whole winding is on the bottom of the drawing, and the last disc is on the top.

In the beginning the two outermost strand conductors 1*a*,1*b* are running through the first bending head and all the other three 1*c*,1*d*,1*e* strand conductors are running through the second bending head. The first and second groups are (1) 1*a*,1*b*, and (2) 1*c*,1*d*,1*e*, respectively, in the lowest disc of the winding. In each twin cross-over 6, these two groups will be crossed so that the outermost group comes innermost and vice versa. In the end of the first section, the second and first groups are (2) 1*c*,1*d*,1*e*, and (1) 1*a*,1*b*, respectively. Accordingly, the first group could be comprised of two innermost strand conductors and another group could be comprised of all the remaining strand conductors.

According to an exemplary embodiment, the standardized twin transposition cross-over 9 can include two groups, as well. First, the user can move the two strand conductors 1*d*,1*e* from the second bending head to the first bending head, and then bend the outermost strand conductor 1*c* and then provide the other group 1*d*,1*e*,1*a*,1*b* in the next spacer span 8. When the first twin transposing cross-over 9 has been made, the groups are 1*d*,1*e*,1*a*,1*b*; and 1*c*. Now the user can arrange the strand conductors so that a group of 1*d*,1*e* will be moved to the first bending head, and the group 1*a*,1*b*,1*c* comes to the second bending head. The whole section will be run by these two bending groups.

Figure 6:
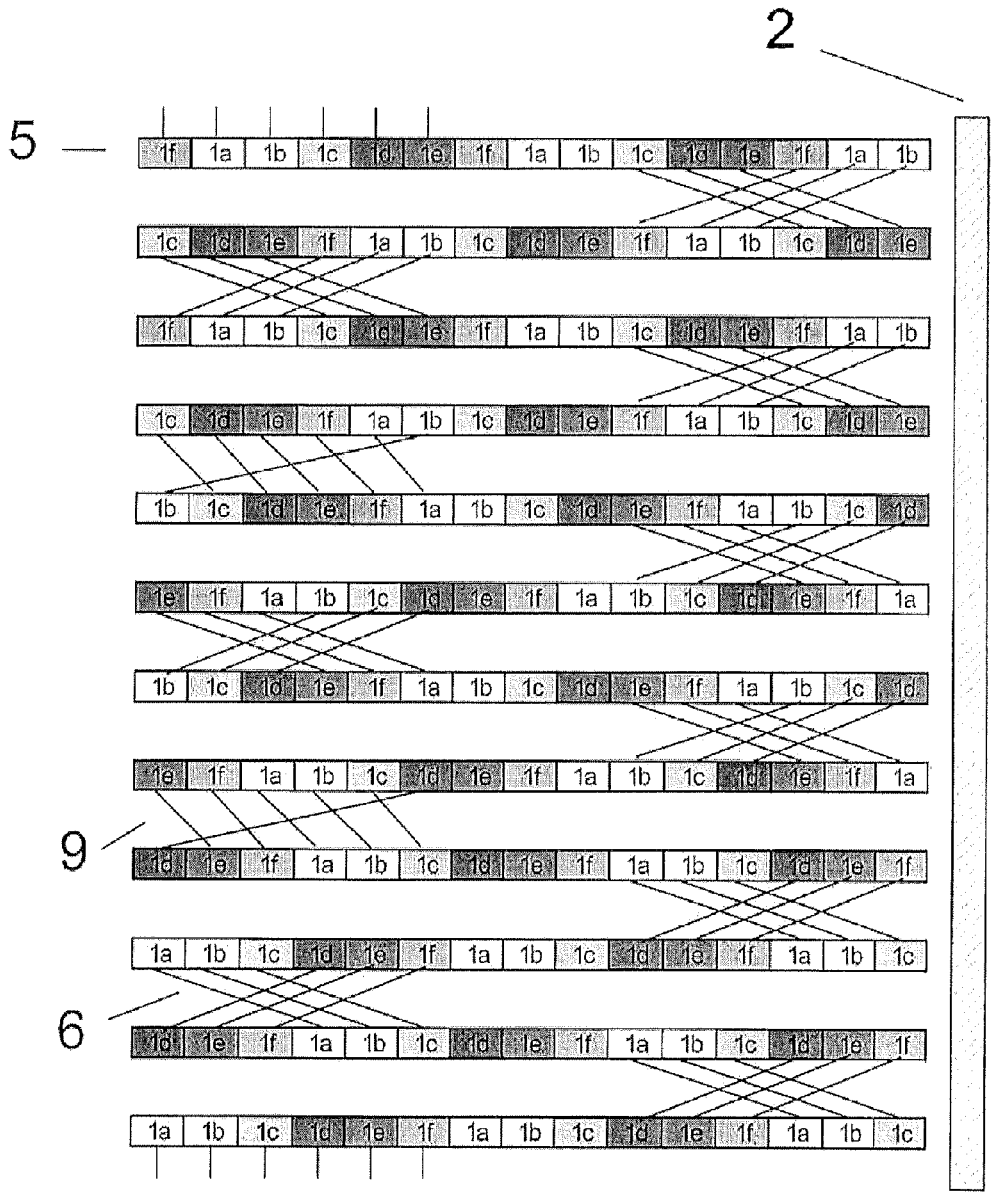
FIG. 6 shows a disc winding cross-over diagram for six parallel strand conductors for half turn discs, according to an exemplary embodiment of the present disclosure.

FIG. 6 shows an example of a disc winding cross-over diagram for six parallel strand conductors 1*a* . . . 1*f* of a half turns disc type of winding, according to an exemplary embodiment. The winding includes three sections in this example, where each section includes four discs 5. Because there are three sections, there are only two transposing cross-overs 9 corresponding to the formula n/2−1, where the number of the strand conductors n is six.

For half turns disc windings, a twin cross-over 6 within a section will have half of the strand conductors in the first group and the remaining half strand conductors in the other group.

When reading the diagram of any half turns disc type winding, it is to be understood that in a twin cross-over 6 the two bendings are going to be done on the opposite side of the coil cylinder 2 of each other.

In the first disc 5, the first group 1*a*,1*b*,1*c* only has two and half turns before the first part of the twin cross-over 6, but another group 1*d*,1*e*,1*f* has a full three turns before the second part of the twin cross-over 6. On the second disc 5, the situation is opposite of the first disc 5, so that as a result there is an equal number of turns for each strand conductor in the winding. This arrangement makes it possible to have not only full turns like 2 or 3 per disc 5 but also half turns such as five turns per two discs making the average 2.5 turns per disc, according to this example.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A disc winding for a power transformer or a choke with cylindrical windings, the disc winding comprising:

a conductor including a plurality of parallel flat strand conductors; and a plurality of axial sections in which the winding is shared, wherein:

each section comprises a plurality of discs, and each disc comprises a plurality of turns of the conductor, each disc being separated by spacers and the space between each spacer being a spacer span, each cross-over within a section is a twin cross-over in which the strand conductors are bent in two groups such that at least two of the strand conductors are comprised in the first group bent in a first spacer span, and the remaining strand conductors are comprised in the second group bent in a second spacer span adjacent the first spacer span, and a twin transposition cross-over is provided between every two axially adjacent sections such that an outermost strand conductor is bent in a third spacer span to be the innermost strand conductor and the remaining strand conductors are bent in another group in a fourth spacer span adjacent the third spacer span.

2. A disc winding as claimed in claim 1, wherein the number of the sections is a multiple of the parallel strand conductors.

3. A disc winding as claimed in claim 1, wherein the number of the sections is half of an even number of the parallel strand conductors.

4. A disc winding as claimed in claim 1, wherein the bendings of the outermost strand conductor and the bendings of the remaining strand conductors of the twin cross-over are arranged essentially to an opposite side of an insulating coil cylinder of each other to provide half turns per disc type windings.

5. A disc winding as claimed in claim 2, wherein the bendings of the outermost strand conductor and the bendings of the remaining strand conductors of the twin cross-over are arranged essentially to an opposite side of an insulating coil cylinder of each other to provide half turns per disc type windings.

6. A disc winding as claimed in claim 3, wherein the bendings of the outermost strand conductor and the bendings of the remaining strand conductors of the twin cross-over are arranged essentially to an opposite side of an insulating coil cylinder of each other to provide half turns per disc type windings.

7. A disc winding as claimed in claim 1, wherein the number of the sections is an odd number of the parallel strand conductors.

* * * * *